US006056571A

United States Patent [19]

Noro

[11] Patent Number: 6,056,571

[45] **Date of Patent: *May 2, 2000**

[54] ELECTRICAL CONNECTOR FOR FLAT ELECTRICAL CONDUCTOR

[75] Inventor: Yutaka Noro, Yokkaichi, Japan

[73] Assignee: Sumitomo Hiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/012,211

[22] Filed: Jan. 23, 1998

[30] Foreign Application Priority Data

Jan. 23, 1997 [JP] Japan ..... 9-010449
Mar. 12, 1997 [JP] Japan ..... 9-058009

[51] Int. Cl.[7] ..... H01R 13/15

[52] U.S. Cl. ..... 439/260; 439/492

[58] Field of Search ..... 439/260, 261, 439/492, 493, 495, 499, 66, 67, 77, 630, 326–329

[56] References Cited

U.S. PATENT DOCUMENTS 4,647,131 3/1987 VanWoensel ..... 439/260
4,778,403 10/1988 Ikesugi et al. ..... 439/329
5,458,506 10/1995 Yamaguchi et al. .
5,580,272 12/1996 Yamaguchi et al. ..... 439/260
5,695,360 12/1997 Seto et al. ..... 439/495
5,842,883 12/1998 Igarashi et al. ..... 439/495

FOREIGN PATENT DOCUMENTS 0 385 019 10/1994 European Pat. Off. .
0 743 715 10/1997 European Pat. Off. .
41 41 376 A1 6/1993 Germany .
4-33671 8/1992 Japan .

*Primary Examiner*—Lincoln Donovan
*Attorney, Agent, or Firm*—Banner & Witcoff, Ltd.

[57] ABSTRACT

A connector adapted to receive a flat electrical conductor, such as a ribbon cable 4, has a lever 3 operable to open and close a conductor receiving opening. The rotative axis of the lever 3 is arranged to resist opening due to tugging of the cable 4 away from a mounting surface 49. The lever 3 is urged to its end positions by cooperation with an external fixing 21 of the connector; this allows a high biasing force without an excessive contact force between the cable 4 and terminals 2 of the connector.

12 Claims, 10 Drawing Sheets

ELECTRICAL CONNECTOR FOR FLAT ELECTRICAL CONDUCTOR

TECHNICAL FIELD

The present invention relates to a connector suitable for attachment to a flat electrical conductor.

BACKGROUND TO THE INVENTION

Examples of prior connectors of this type are those disclosed in JP-4-33671 and JP-6-77186, which are used for ribbon cables, an example of a flat electrical conductors, comprising a flexible printed circuit board (FPC); such FPC conductors consist of thin flat conductors which lie between flexible insulating films. The disclosure of JP-4-33671 is illustrated in FIG. 19 thereof and comprises a connector housing a, one face of which is open forming an insertion hole b, a plurality of terminals c being arranged towards the lower face of the insertion hole b. The upper face of the insertion hole b has a rotatable cover d which serves as a supporting member. When a ribbon cable e is to be attached, as shown in FIG. 19A, the cover d is opened upwards and the ribbon cable e is inserted between the cover d and the terminal c. After that, as shown in FIG. 19(B), by closing the cover d the ribbon cable e is clamped between the cover d and the terminal c. In this manner, the ribbon cable e is maintained in contact with the terminal c.

The invention of JP-6-77186 has the same configuration.

In other words, in the conventional case, before the ribbon cable e is inserted, it is necessary to perform the operation of opening the cover d upwards using a finger. In recent years, due to a trend towards lowering of the rear of the connector housing a, the space for placing a finger on the cover d has become insufficient. In addition, since operators often work using gloves, the operation of opening the cover d is difficult, and the operation takes time.

In the conventional example, when the ribbon cable e is in a clamped state, if the cover d is inclined towards the direction of opening beyond a certain rotative angle, a force applies on the cover d in the direction of opening due to the recovery force exerted as a result of the resilience of the terminal c. On the other hand, if the cover d is inclined towards the closing direction, the force applies in the closing direction. As a result, the cover d can be maintained in an open state or in the closed state without having to provide a separate locking means.

However, the force applying on this cover d uses the force exerted due to the resilience of the terminal c. Accordingly, when the terminal c is bent, there is a possibility of an excessive force applying on the ribbon cable e, this force exceeding the normal contact pressure.

Furthermore the biasing force of the terminal on the cover d may be insufficient; a stronger force from the terminal is possible, but this may increase the electrical contact force to an undesirable level.

From the supported position shown in FIG. 19B, if a pulling force is exerted at the location of the insertion hole on the ribbon cable e in a direction (shown by the arrow f), the ribbon cable e tends to raise the operating end of the cover d, resulting in a possible deterioration of reliability of contact.

The present invention is based on the above circumstances and aims to make the attachment operation of a flat electrical conductor simpler and more efficient, and has a further aim of increasing the reliability of the connection.

SUMMARY OF THE INVENTION

According to the invention there is provided an electrical connector for attachment to the end of a flat electrical conductor, the connector comprising a housing having a base and defining a mouth to receive a flat electrical conductor, an electrical terminal in the housing and having a protrusion protruding into said mouth, and a lever pivotably mounted on the housing for movement between an open condition, in which said mouth is open, and a closed condition in which a portion of said lever protrudes towards said protrusion and into said mouth to clamp said conductor against said terminal, thereby making an electrical connection, the lever having pressing member at one end thereof, the pressing member being movable towards said base from the open to the closed condition and being located distally of the opening of said mouth.

Such a connector has a pivoted operating lever that is not susceptible to opening should the ribbon conductor be pulled away from the mounting surface; in fact, contact between the ribbon conductor and the lever will tend to maintain rather than release engagement with a respective terminal.

In the preferred embodiment the pivot axis of the lever is on the opposite side of the mouth to the terminal protrusion, and preferably lies between the mouth and the base of the housing.

The lever may be doubled ended so as to rock like a see-saw. Preferably the lever lies approximately parallel to the mounting surface in the closed condition so as to minimize upward protrusion thereof.

In a preferred embodiment the connector includes biasing means to temporarily maintain the lever in the open condition, the closed condition, or both. These biasing means preferably act on an axle of the lever, and in the preferred embodiment the axle has a cam profile pressing on a spring and arranged such that a peak of the cam profile is between the open and closed conditions of the lever; in this way the lever is urged to one or other end conditions. The spring may be a cantilever arm of a member for attaching the connector to a mounting surface; this arrangement has the particular advantage that the force of the biasing means is independent of the contact pressure of the connector terminal on a flat conductor such as a ribbon cable.

BRIEF DESCRIPTION OF DRAWINGS

Other features of the invention will be apparent from the following description of several preferred embodiments shown by way of example only in the accompanying drawings, in which.

DESCRIPTION OF PREFERRED EMBODIMENTS

A first embodiment is explained with the aid of FIGS. 1 to 9.

Figure 1:
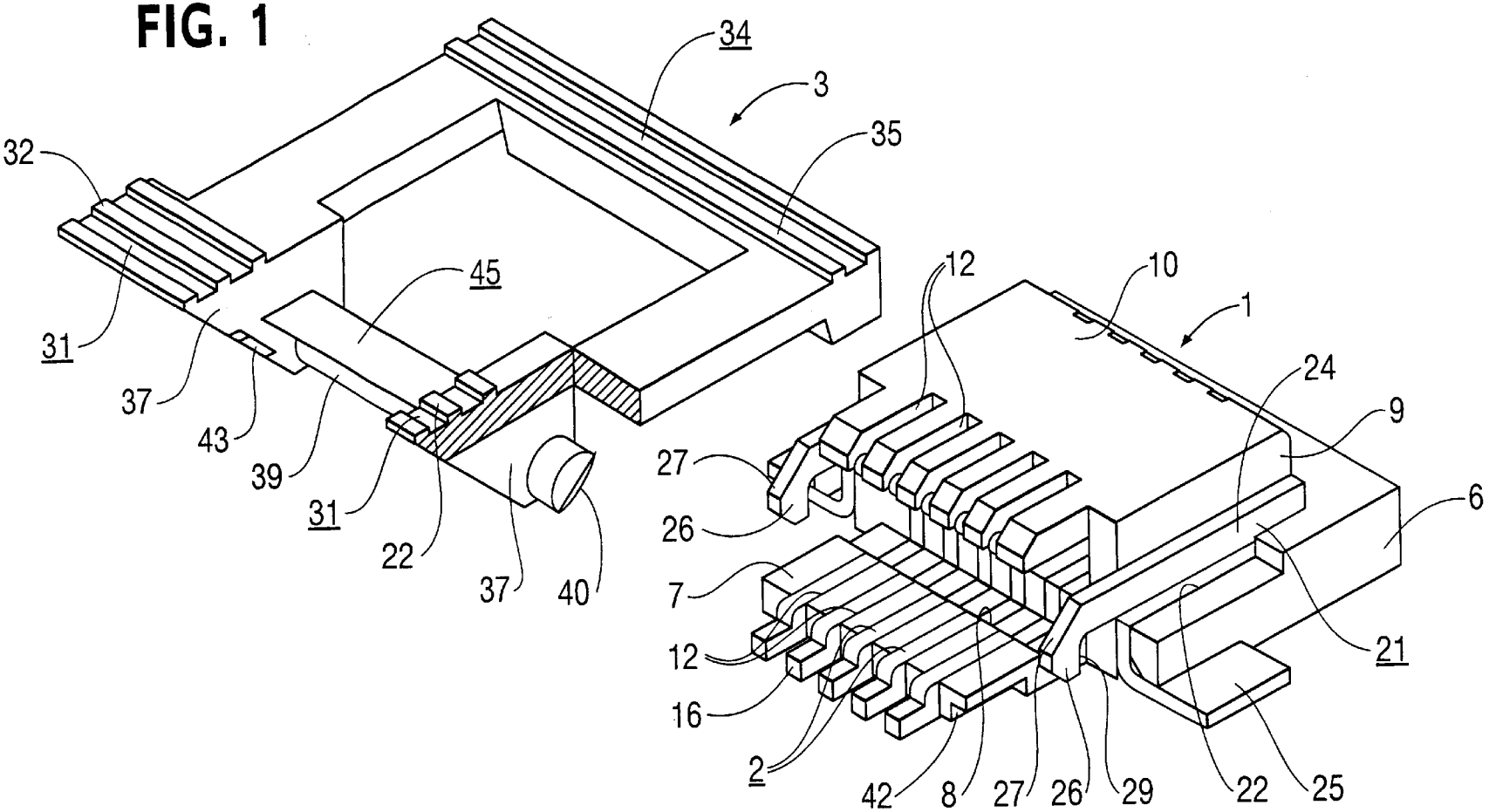
FIG. 1 is a partially cut away diagonal view of a connector relating to a first embodiment of the present invention.

As shown in FIG. 1, a connector of the present embodiment comprises a connector housing 1, a plurality of terminals 2 housed within the connector housing 1, and a movable operating lever 3 attached to the connector housing 1. A flat electrically conductive path used in the present embodiment is a ribbon cable 4 made from FPC (see FIG. 4C), and has a configuration whereby a bendable belt-shaped base film has a plurality of evenly spaced conductive paths formed thereon by printing.

The connector housing 1 is formed from synthetic resin, and has a main body 6 that has a thick rectangular plate shape when seen from above, and a base 5. The posterior end of the upper face of the main body 6 is stepped so as to be at a greater height, and a plate shaped protruding member 7 protrudes from a portion on the lower end of the anterior face of the main body 6, this portion being centrally located with respect to the width-wise direction. The upper face of the root portion of the protruding member 7 has lower axis receiving members 8 forming grooves along the entire width. Further, the locations on the upper face of the main body 6 corresponding to the immediate exterior of the protruding member 7 have a pair of left and right side plate members 9. These extend vertically from the anterior end of the main body 6 to a location that is at a specified distance in an anterior direction from the posterior end, a roof member 10 being formed between these side plate members 9. The anterior end of the roof member 10 protrudes anteriorly with respect to the anterior face of the main body 6.

Five slits 12 are formed in an anterior-posterior direction at intervals along the protruding member 7, the main body 6, and a portion of the roof member 10. These slits 12 serve as housing chambers for the terminals 2.

Figure 4A:
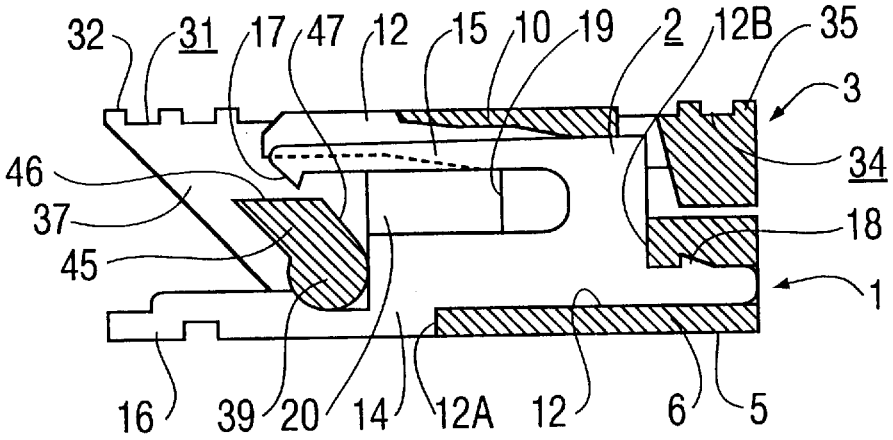
FIGS. 4A–4C are cross-sectional views explaining the attachment process of a ribbon cable.

The terminals 2 are formed by punching out an electrically conductive metal plate. As shown in FIG. 4A, the shape of the terminal 2 is such that there is a long and narrow base member 14 extending in an anterior-posterior direction that is inserted into a portion of the slit 12 from the protruding member 7 up to the main body 6, and a contact member 15 that rises upwards from the posterior end of the base member 14 and protrudes anteriorly. The anterior end of the base member 14 comprises a lead member 16 that is soldered onto an electrically conductive path formed by a printed circuit board (not shown), and the anterior end of the contact member 15 has a downward inclined protruding member 17.

The terminal 2 is inserted into the corresponding slit 12 from the anterior end (the left side in FIG. 4A), and the insertion stops when the lower edge of the stepped portion of the base member 14 and the rising portion of the contact member 15 respectively make contact with protruding members 12A and 12B. At this juncture, the stopping protrusion 18 formed on the posterior end of the base members 14 engages with the side wall of the slit 12, thereby making the terminal 2 unremovable. Further, the root portion of the contact member 15 and the base member 14 are prevented from moving by being clamped between the roof ember 10 and the upper and lower faces of the slit 12 in the main body 6. Here, the anterior end of the contact member 15 rests on the lower end of the slit 12, thereby making it possible for the contact member 15 to bend upwards. Further, the anterior end of the lead member 16 protrudes by a specified dimension from the anterior end of the protruding member 7 (see FIG. 1).

Figure 4B:
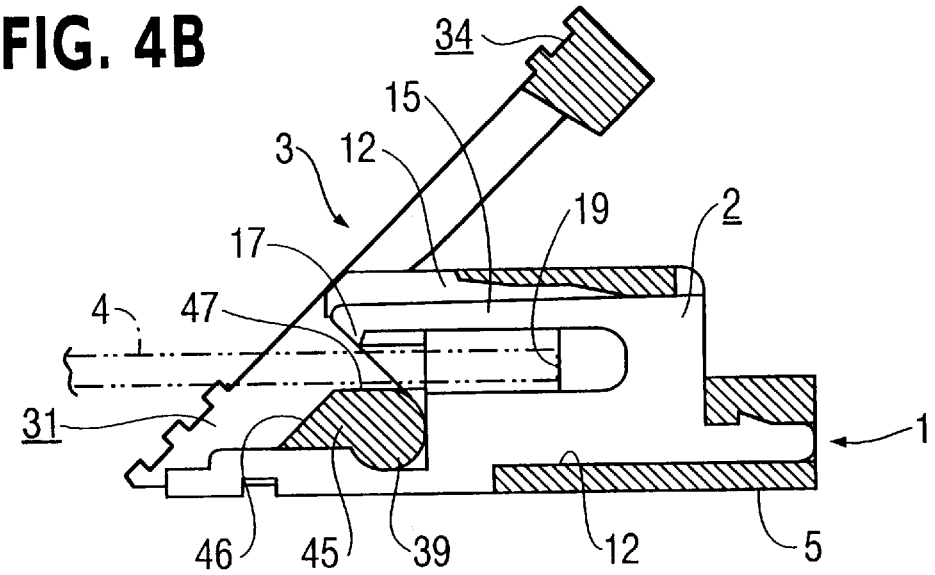

As described above, a ribbon cable is insertable into a mouth 20 between the base member 14 and a contact member 15 of each terminal 2. Further, as shown in FIG. 4B, the inner ends of the portions between the slits 12 have stopping members 19 for stopping the insertion of the ribbon cables 4 when the anterior ends of the ribbon cables 4 make contact with the stopping members 19.

Figure 7:
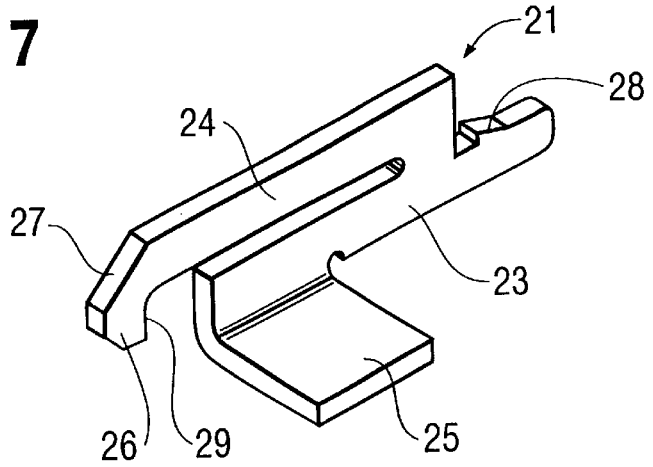
FIG. 7 is a diagonal view of a holder.

The connector housing 1 has an attachable holder 21 for fixing the connector housing 1 with the printed circuit board. For this reason, a pair of left and right attachment grooves 22 are formed facing in an anterior-posterior direction, the attachment grooves 22 being formed on the external sides of the side plate members 9. The holder 21 is formed by punching from a metal plate. As shown in FIG. 7, this holder 21 comprises a long and narrow base member 23 that extends in an anterior-posterior direction and that is inserted into the attachment groove 22, an arm member 24 rising upwards slightly from the posterior end of the base member 23 and protruding anteriorly, and an attachment member 25 extending outwards by being bent at a right angle from the lower edge of the anterior end of the base member 23. The anterior end of the arm member 24 protrudes anteriorly beyond the anterior end of the base member 23 by a specified distance, and has a downward facing hook member 26 formed thereon. Further, the bent and angled portion of the hook member 26 is angled diagonally, forming a guiding member 27 as illustrated.

Figure 6:
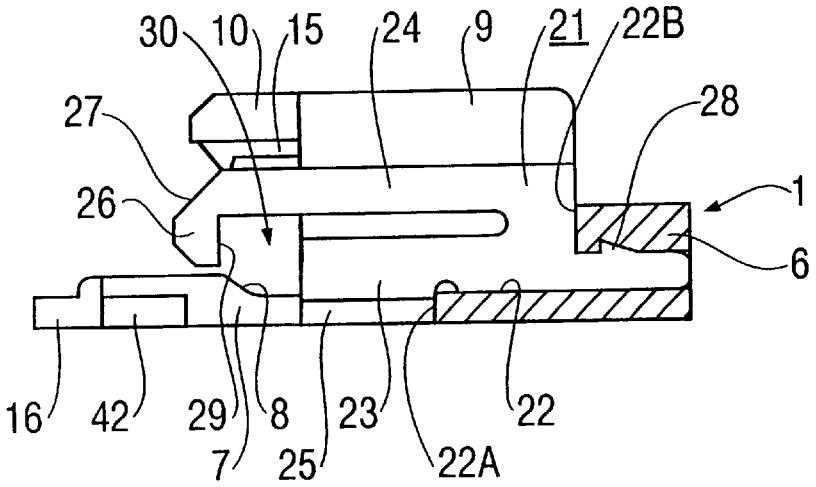
FIG. 6 is a cross-sectional view along VI—VI in FIG. 5.

The holders 21, having a configuration as described above, are inserted into the corresponding attachment grooves 22 from the front. As shown in FIG. 6, the root portion of the attachment member 25 and the rising portion of the arm member 24 make contact with the contact members 22A and 22B of the attachment groove 22, thereby being prevented from being pushed in any further. At this juncture, the stopping protrusion 28 provided on the posterior side of the base member 23 engages with the side wall of the attachment groove 22 and thereby becomes unremovably attached. As shown in FIG. 6, the hook member 26 at the anterior end of the arm member 24 protrudes into the anterior face of the main body 6, an upper axis receiving member 29 being formed therein. This forms a pair with the above-mentioned lower axis receiving member 8, which together constitute an axis receiving member 30 of a axle 39 of an operating lever 3, described below.

Figure 2:
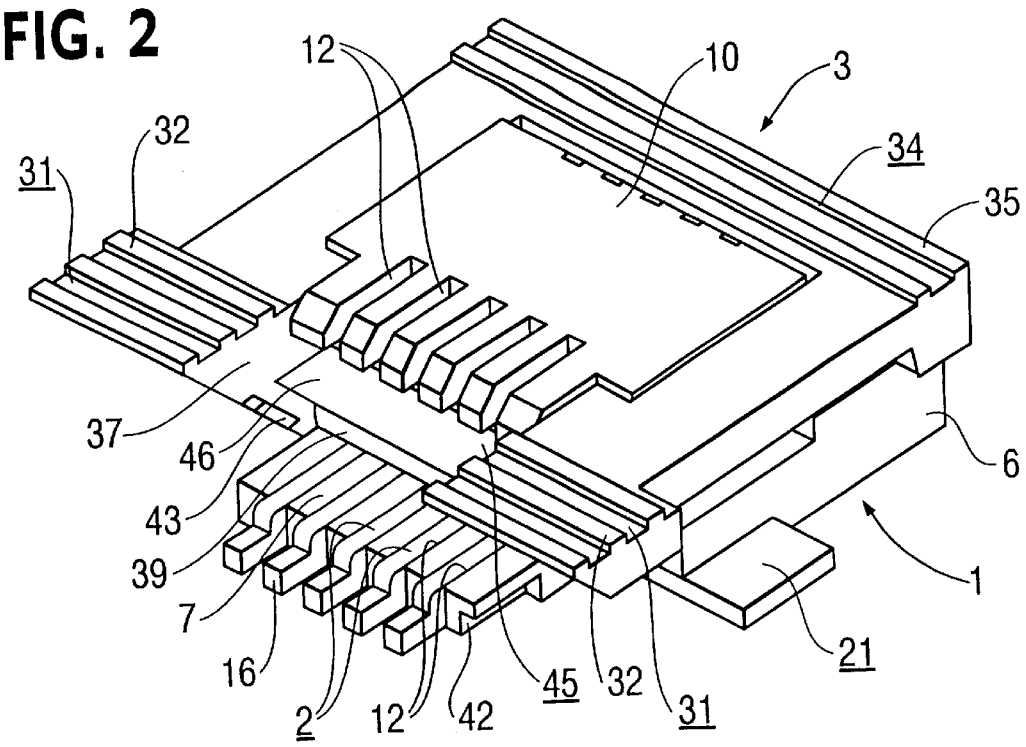
FIG. 2 is a diagonal view showing an operating lever in a supporting position.
Figure 3:
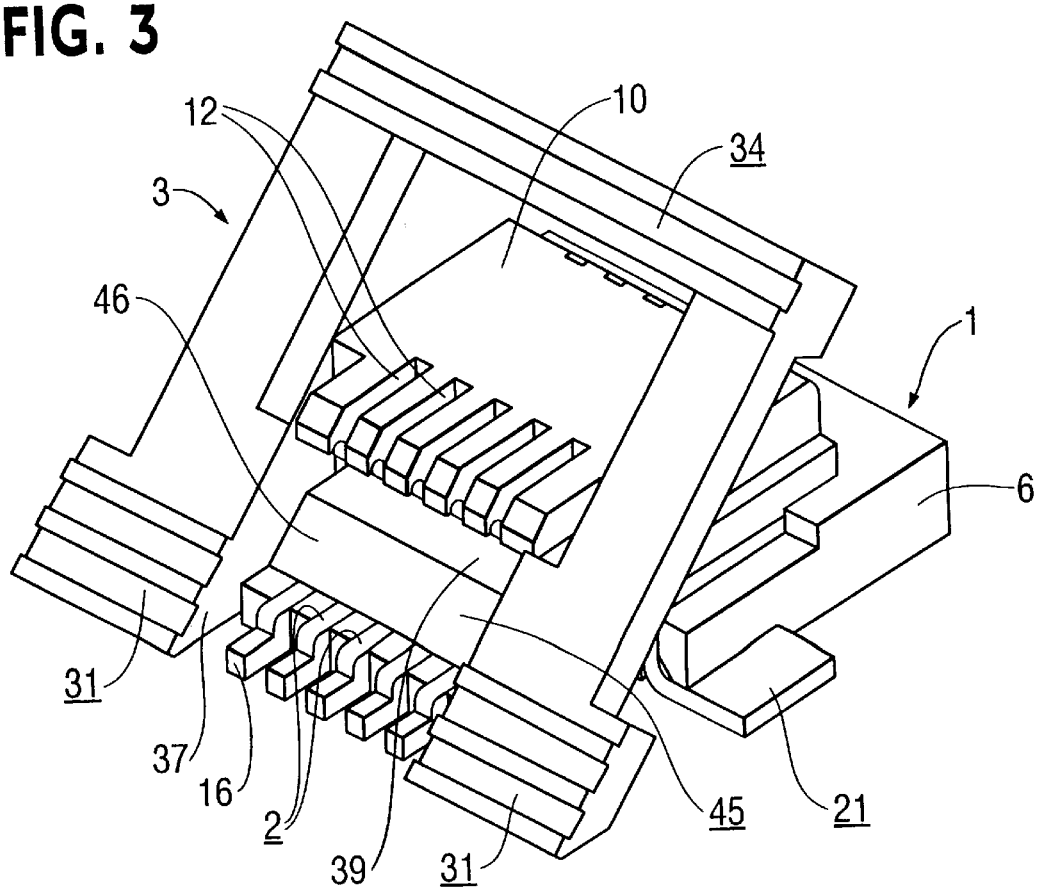
FIG. 3 is a diagonal view showing the operating lever in a releasing position.

The operating lever 3 is formed from synthetic resin. It has a frame shape whereby it surrounds from the posterior side the left and right side edges of the roof member 10, the anterior end thereof being open. As shown in FIG. 2, the anterior ends of the left and right sides of the operating lever 3 protrude outwards with respect to the anterior face of the roof member 10. Further, the portions protruding from the anterior face of the roof member 10 extend outwards. In this manner, a pair of first pressing members 31 is formed. The upper faces of each of the first pressing members 31 have a series of concave and convex anti-skid surfaces 32 formed along an anterior-posterior direction. The posterior side of the lever 3 constitutes a thick second pressing member 34 that extends along the entire length. The upper face of this second pressing member 34 also has a concave and convex anti-skid surface 35 formed along an anterior-posterior direction.

Figure 8:
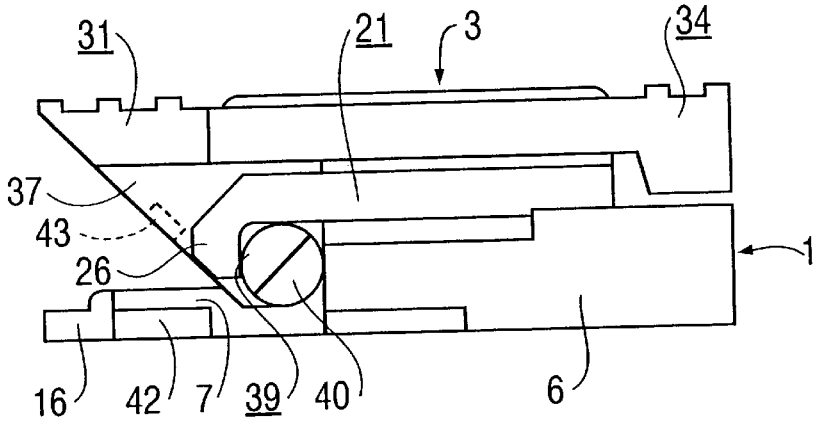
FIG. 8 is a side view showing a connector wherein the operating lever is in the supporting position.

The anterior ends of the left and right sides of the operating lever 3 have supporting plates 37 extending downwards along the inwardly widened portions. As shown in FIG. 4A, these supporting plates 37 have vertical posterior sides and the anterior sides gradually incline towards the lower end in the posterior direction, forming an inverted trapezoid. These are formed so as to clamp the protruding members 7 of the connector housing 1. An axle 39 is formed so as to pass between the supporting plates 37. Consequently, the first pressing members 31 and the second pressing member 34 are located anteriorly and posteriorly so as to surround the axle 39. As shown in FIG. 8 as well, the end faces of the axle 39 protruding outwards from the supporting plates 37 have tapered guiding faces 40 formed on the portions of the semi-circular part located posteriorly and towards the lower side.

From the state shown in FIG. 1, the operating lever 3 is inserted diagonally from the front by bringing the guiding faces 40 on the protruding ends of the axle 39 against guiding members 27 on the arm members 24. The axle 39 is inserted due to the widening caused by the guiding faces 40 of the arm members 24. After the protruding ends of the axle 39 are pushed beyond the posterior sides of the hook members 26 of the holders 21, the arm members 24 return to their original shape and the axle 39 is clamped by the axis receiving members 30. Specifically, the lower face sides of the axle 39 are received by the lower axis receiving members 8, and the upper face sides are clamped by the upper axis receiving members 29. In this manner, the operating lever 3 is supported movably in the connector housing 1 with the axle 39 as centre.

Figure 9:
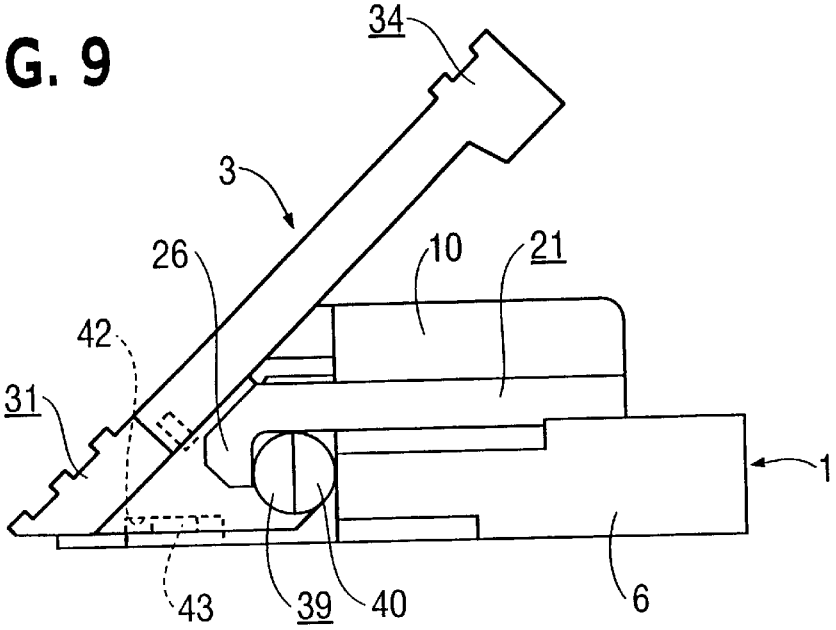
FIG. 9 is a side view showing a connector with the operating lever in a releasing position.

The clockwise movement of the operating lever 3 shown in FIG. 4 is limited by the lower face of the second pressing member 34 making contact with the upper face at the posterior end of the main body 6. At this juncture, the operating lever 3 assumes a horizontal position as shown in FIG. 4A; this is the supporting position. Further, as shown in FIG. 4B, the operating lever 3 can rotate in an anti-clockwise direction from the supported state up to an angle of 45 degrees. This is the releasing position. The operating lever 3 is temporarily maintained in the releasing position so that it does not drop due to its own weight. For this reason, as shown in FIGS. 1, 8 and 9, the left and right side faces at the anterior end of the protruding member 7 have concave temporary support members 42 formed thereon. Along with this, the inner faces of the supporting plates 37 of the operating lever 3 have protrusions 43 that fit with support members 42 when the operating lever 3 is moved to the releasing position.

The area between the supporting plates 37 in the axle 39 has a supporting member 45 formed uniformly thereon, this supporting member 45 serving to clamp the ribbon cable 4 with the terminal 2. When the operating lever 3, is in the supporting position shown in FIG. 4A, the supporting member 45 protrudes diagonally in an anterior direction from the upper face of the axle 39 and the anterior end face, constituting a clamping and supporting face 46, assumes a horizontal position and approaches the protruding member 17. When the operating lever 3 is moved to a releasing position, as shown in FIG. 4B, the edge 47 at the posterior end of the supporting member 45 assumes a horizontal position, thereby creating a space between it and the protruding member 17 that is greater than the thickness of the ribbon cable 4.

The operation of the first embodiment is as follows. The terminal 2 and the holder 21 are attached to the connector housing 1 in the manner described earlier. Along with this, the operating lever 3 is inserted into the axis receiving member 30. The operating lever 3 is normally stored and transported, etc., in the supporting position shown in FIG. 4A. The connector housing 1 is fixed in place by soldering the attachment member 25 of the holder 21 at a specified position on the printed circuit board, and the lead member 16 of each terminal 2 is connected by soldering it to the corresponding electrically conductive path of the printed circuit board.

The procedure for attaching the ribbon cable 4 to the connector housing 1, is as follows. The first pressing members 31 of the operating lever 3 are pressed from the state shown in FIG. 4A and the operating lever 3 is rotated in an anti-clockwise direction to the releasing position (FIG. 4B). As shown in FIG. 9, the protrusions 43 of the operating lever 3 enter the concave temporary support members 42 of the protruding members 7 to temporarily maintain the lever 3 in the supporting position.

Figure 4C:
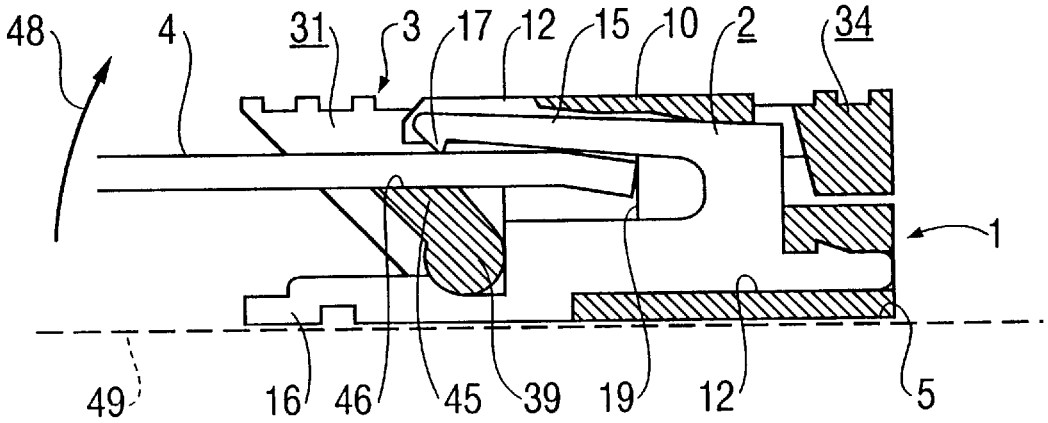
Figure 5:
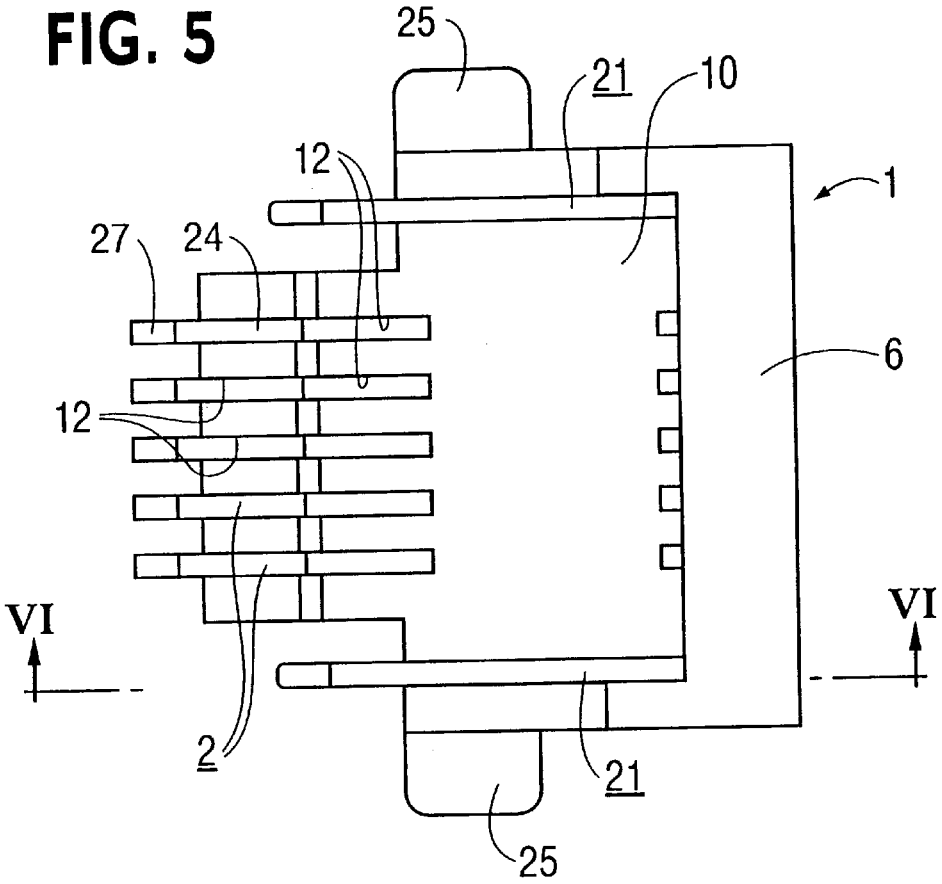
FIG. 5 is a plan view of the connector housing.

The ribbon cable 4 is pushed into the mouth 20 between the contact member 15 of the terminals 2 and the supporting members 45, with the conductive path facing upwards. As shown by the chain line in FIG. 4B, the pushing-in ends when the anterior end of the ribbon cable 4 makes contact with the stopping member 19. The second pressing member 34 is then pressed towards the base 5, the protrusions 43 are separated from the concave temporary support members 42, and the operating lever 3 is moved in a clockwise direction, reaching the supporting position, as shown in FIG. 4C. Simultaneously, the supporting member 45 also moves in the same direction, and as a result, the contact member 15 of the terminal 2 bends upwards and the ribbon cable 4 is resiliently supported between the clamping and supporting face 46 and the protruding member 17. In this manner, each conductive path of the ribbon cable 4 is maintained in a state of contact with the contact member 15 of the corresponding terminal 2.

When the ribbon cable 4 is to be removed the operation is reversed.

Accordingly, the connecting operation of the ribbon cable 4 can be carried out easily and effectively. Moreover, since anti-skid surfaces 32 and 35 are formed on the pressing members 31 and 34, the pressing operation of the operating lever 3 is also facilitated.

Since the lead member 16 of the terminal 2 is arranged to protrude out at the front in the space formed by the protrusion of the first pressing members 31, the overall lengthwise dimension of the connector housing 1 can be reduced, making the storage and transportation of the connector housing 1 convenient.

In the state where the ribbon cable 4 is connected to the connector housing 1, there is often a space above the connector mounting plate represented by the dotted line 49 in FIG. 4C. Consequently, as shown by the arrow 48 in FIG. 4C, there is a possibility of the ribbon cable 4 being bent upwards and being pulled. In such a case, the first pressing members 31 of the operating lever 3 are in a state whereby they clamp the ribbon cable 4, and the other, second pressing member 34 is in a location that faces in a direction opposite to the direction of opening of the insertion hole. In either case, there is no possibility of the ribbon cable 4 getting caught with the operating lever 3 and rotating it in the releasing direction. Thus the connected state is reliably maintained.

Figure 10A:
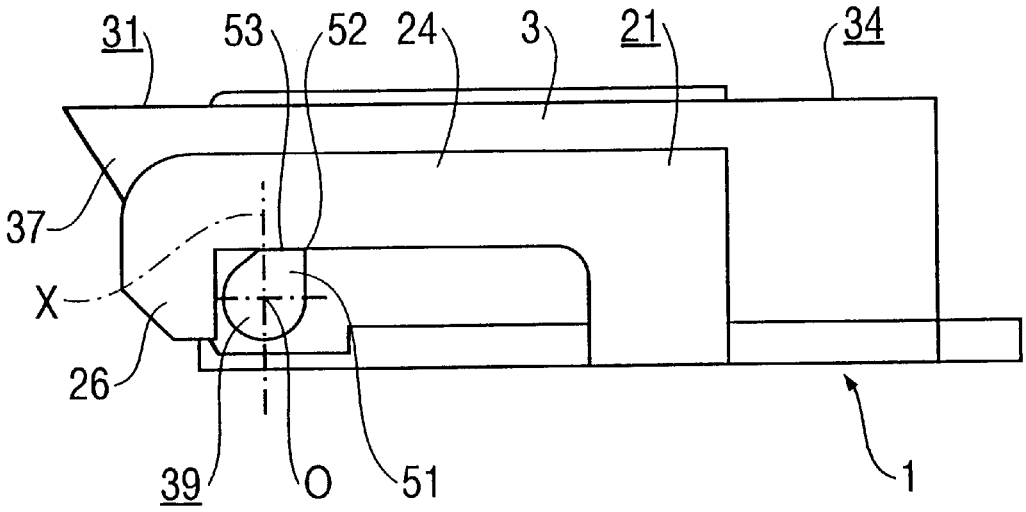
FIG. 10A is a side view of a connector relating to a second embodiment of the present invention in the supporting position.
Figure 10B:
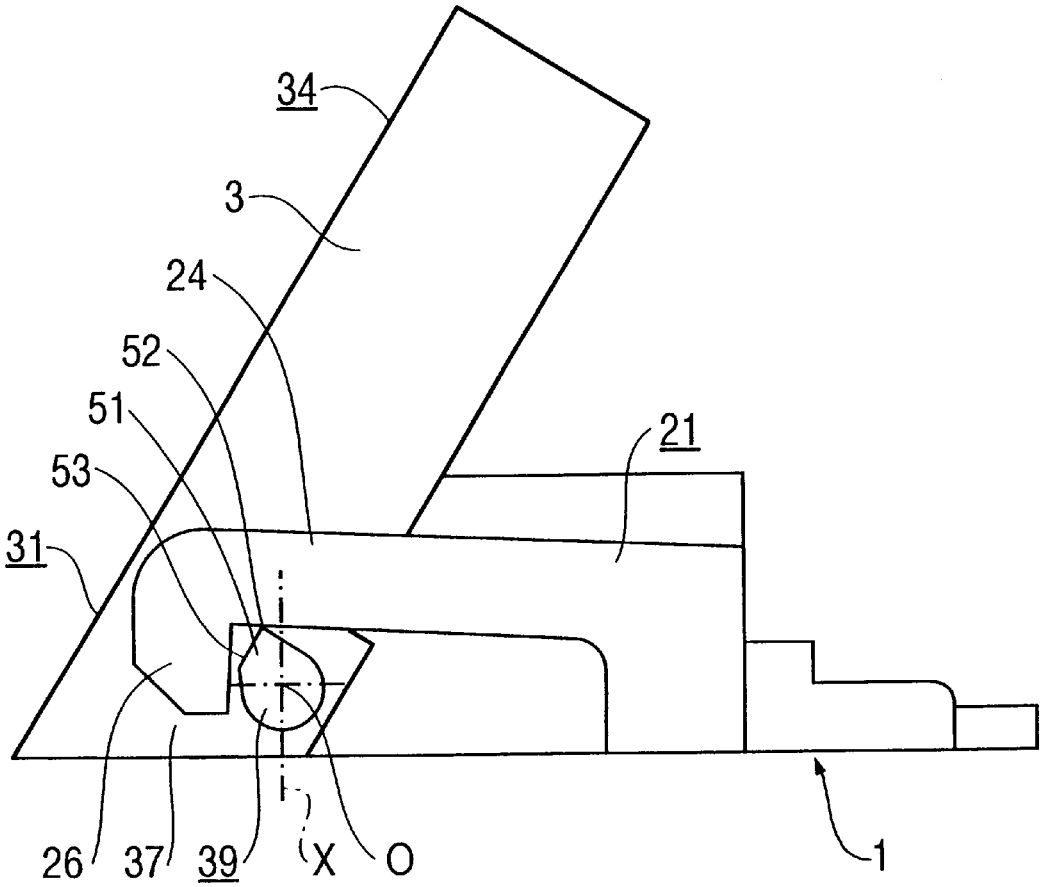
FIG. 10B is a side view of a connector relating to a second embodiment of the present invention in the releasing position.
Figure 11:
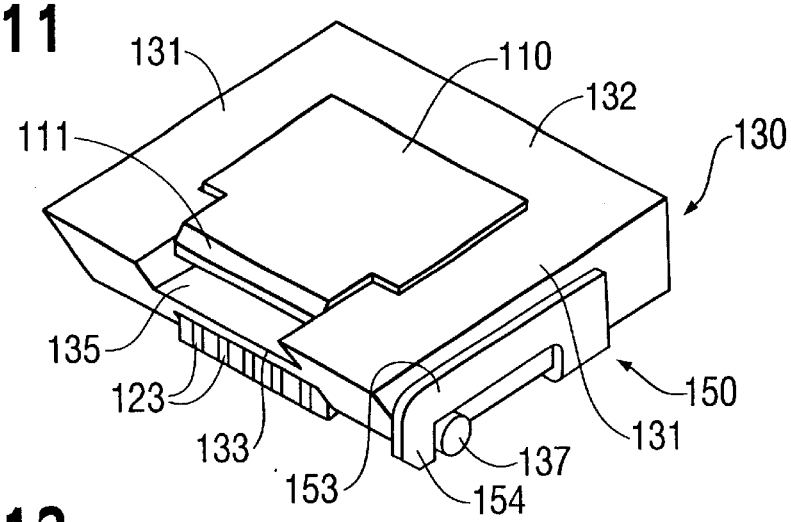
FIG. 11 is a diagonal view of a third embodiment showing a connector from an insertion side in a state whereby the supporting member is in the supporting position.
Figure 12:
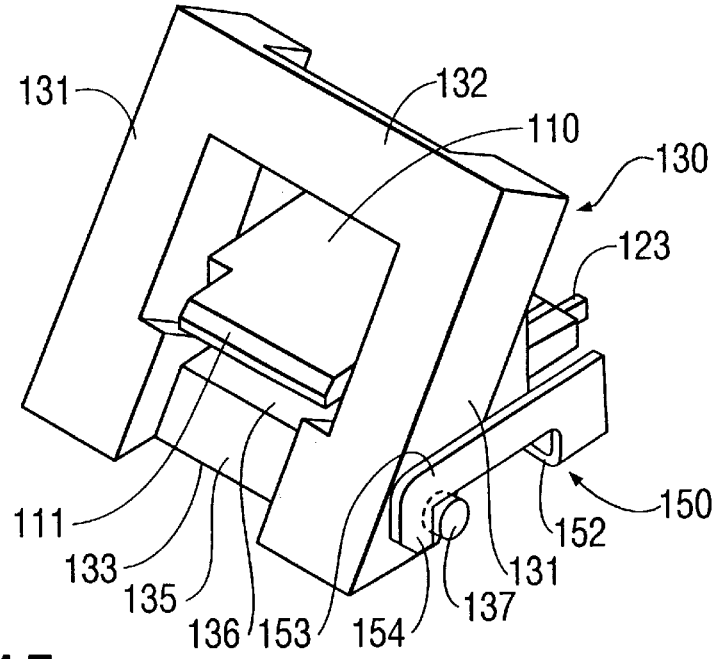
FIG. 12 is a diagonal view of the connector from the insertion side in a state whereby the supporting member is in the releasing position.

A second embodiment of the present is explained with the aid of FIGS. 10A and 10B. The second embodiment differs in the configuration of the portion according to which an operating lever 3 is temporarily maintained in a releasing position. The second embodiment has approximately triangularly shaped cam members 51 formed on a portion of the external periphery at the ends protruding from supporting plates 37 in an axle 39 of the operating lever 3. Moreover, as shown in FIG. 10A, when the operating lever 3 is in the supporting position, a peak 52 of the cam member 51 is located posteriorly with respect to a vertical line X that passes through an axis centre 0. An inclined member 53 located towards the anterior in the cam member 51 makes full contact with the lower edge of an arm member 24 of a holder 21, which is in its natural position. Further, as shown in FIG. 10B, when the operating lever 3 is in a releasing position, the peak 52 of the cam member 51 is located anteriorly with respect to the vertical line X that passes through the axis centre 0 and presses on to the lower edge of the arm member 24.

In other words, when first pressing members 31 are pressed and the operating lever 3 is moved from the supporting position, the cam member 51 presses against the lower edge of the arm member 24 of the holder 21 by means of its peak 52 and thereby makes the arm member 24 bend upwards. When the releasing position shown in FIG. 10B is reached, the peak 52 moves to a position anterior with respect to the vertical line X. Accordingly, the arm member 24 functions as a stopper and thereby prevents the cam member 51 from rotating from the releasing position. If a second pressing member 34 is pressed when the operating lever 3 is in the state shown in FIG. 10B, the lever 3 can be moved to the supporting position. Thus the force holding the lever in either end position is not due to the electrical contacts, and can be set at a suitable level without risk of an excessive electrical contact force.

A third embodiment of the present invention is described with the aid of FIGS. 11 to 18.

A connector comprises a connector housing 110, a plurality of terminals 120 which are attached to this connector housing 110, and a supporting member 130 that is attached rotatively to the connector housing 110.

A sheet conductive path that applies in the present embodiment is a ribbon cable 140 made of FPC. It has a configuration whereby the upper surface of a flexible sheet has a plurality of conducting paths (in the present embodiment 5 conducting paths) which are evenly spaced and which are formed by means of printing. A contact member 121A of the terminal 120 (to be described later) makes contact with the anterior end of each conductive path.

The connector housing 110 comprises a housing main body 110A, and a holder 50, to be described later. The housing main body 110A comprises a protruding overhanging plate shaped supporting member 111 that protrudes anteriorly from its upper face, and a receiving member 112 that also protrudes anteriorly from below the supporting member 111. An insertion space (mouth) 113 is formed between the supporting member 111 and the receiving member 112 and serves to allow the insertion of the anterior end of the ribbon cable 140. Furthermore, the housing main body 110A has a plurality of vertical slit shaped cavities 114 aligned so as to extend between the anterior and posterior faces of the housing main body 110A (there are 5 such cavities 114 in the present embodiment). The posterior lower face of each cavity 114 connects with a posterior face slit 115 that opens into the posterior face of the housing main body 110A. Furthermore, this posterior lower face also connects with a base face slit 116 that opens out into the base face of the housing main body 110A. A terminal 120 is inserted into each cavity 114.

The terminal 120 comprises a resilient contact member 121 that extends in an anterior-posterior direction, a connecting member 122 that protrudes downwards from the posterior edge of the resilient member contact member 121, and a base plate attachment member 123 that protrudes in an anterior-posterior direction from the lower end of the contact member 122. The resilient contact member 121 is inserted from the posterior end into the cavity 114 and is aligned to the lower face of the supporting member 111. Along with this, the connecting member 122 and the anterior end of the base plate attachment member 123 are respectively inserted into the posterior face slit 115 and the base face slit 116. In this manner, the terminal 120 is housed in the housing main body 110A. The posterior end of each base plate attachment member 123 is connected to conductive paths on the upper face of a circuit board (not shown) by means of soldering.

The resilient contact member 121 can resiliently move in an up-down direction. Furthermore, its anterior end protrudes anteriorly with respect to the receiving member 112 and has a triangular downward protruding contact member 121A formed thereon. The anterior end of the base plate attachment member 123 also protrudes anteriorly with respect to the receiving member 112 as in the case of the resilient contact member 121. A semi-circular shaped axis receiving concave member 124 is formed at the anterior end of the base plate attachment member 123 at a location that is approximately below the contact member 121A. The supporting member 130 is supported in this axis receiving concave member 124.

The supporting member 130 is made from insulating material and comprises a pair of left and right lever members 131, a moving member 132 that connects the anterior ends of these lever members 131, and a moving member 133 that connects the base ends of the lever members 131. The supporting member 130 forms a rectangular frame shape. The moving member 133 has an arc shaped axis member 134. By fitting the arc shaped axis member 134 into the axis receiving concave member 124, the supporting member 130 becomes moveable between the supporting position (shown in FIGS. 11, 14A, 15 and 17) and the releasing position (shown in FIGS. 12, 14C and 16) with respect to the connector housing 110. When the supporting member 130 is in the supporting position, the supporting member 130 assumes a horizontal condition and is in a state whereby it surrounds the periphery of the housing main body 110A. When the supporting member 130 is in a releasing position it assumes an inclined position and is in a state whereby it lies above the connector housing 110.

The moving member 133 has a clamping and supporting face 135 formed thereon which faces the contact member 121A when the supporting member 130 is in the supporting position, the space between the contact member 121A and the clamping and supporting face 135 being slightly less than the thickness of the ribbon cable 140. The moving member 133 also has a guiding face formed thereon which faces the contact member 121A in the releasing position, the space between the contact member 121A and the guiding face being slightly greater than the thickness of the ribbon cable 140. This clamping and supporting face 135 and the guiding face both face the contact member 121A in such a manner as to be parallel to the direction of insertion of the ribbon cable 140.

When the ribbon cable 140 is to be attached to the connector housing 110, the supporting member 130 is brought to the releasing position and the anterior end of the ribbon cable 140 is inserted into the insertion space 113. Next, the supporting member 130 is rotated so as to be brought down to the supporting position. When this is done, the clamping and supporting face 135 raises the ribbon cable 140 and resiliently bends the resilient contact member 121. Due to the recovery force exerted on account of the resilience of the resilient contact member 121, the contact member 121A engages with the upper face of the ribbon cable 140 and as a result the ribbon cable 140 is clamped and supported between the supporting member 130 and the terminal 120, the contact member 121A making contact with a conductive path (not shown) located on the upper face of the ribbon cable 140. When the ribbon cable 140 is to be removed, the supporting member 130 is rotated to the releasing position and the ribbon cable 140 is pulled out.

The arc shaped axis member 134 is mounted onto the axis receiving concave member 124 and is supported by the latter from below. By using the arc shaped axis supporting configuration, a simpler configuration is achieved for the supporting member 130 and the connector housing 110 is miniaturized (in particular the height can be reduced).

In this embodiment, the external side faces of the lever members 131 respectively have rotative axles 137 protruding therefrom. These axles 137 have the same centre as the arc shaped axis member 134, the external periphery of the axles 137 having schematically triangular shaped cam members 137A protruding therefrom. A pressing force due to resilience applies downwards on the cam members 137A from the cam receiving members 153 of the holder 150 (described below), a rotative force applying on the axles 137 towards the supporting position or the releasing position due to the pressing force exerted by the resilience of the cam receiving members 153.

Figure 18:
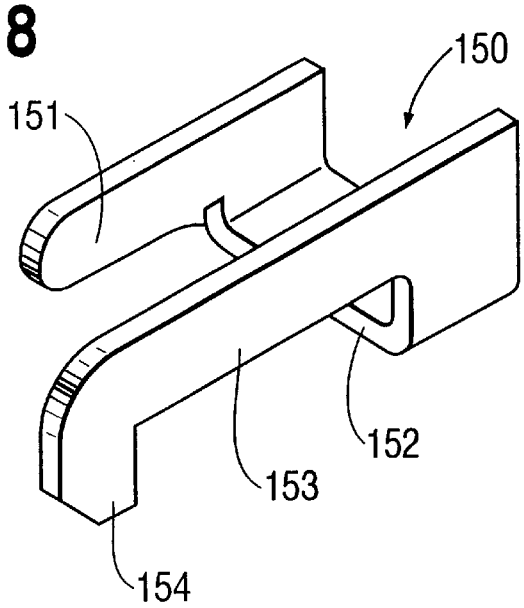
FIG. 18 is a diagonal view of the holder.
Figure 19A:
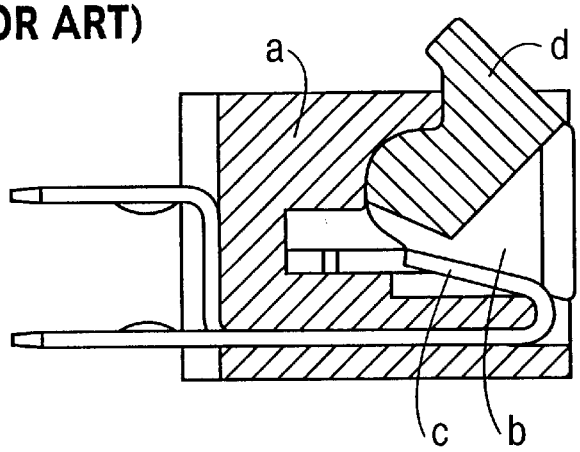
FIG. 19A (PRIOR ART)
FIGS. 19A and 19B are cross-sectional views of a prior art example.
Figure 19B:
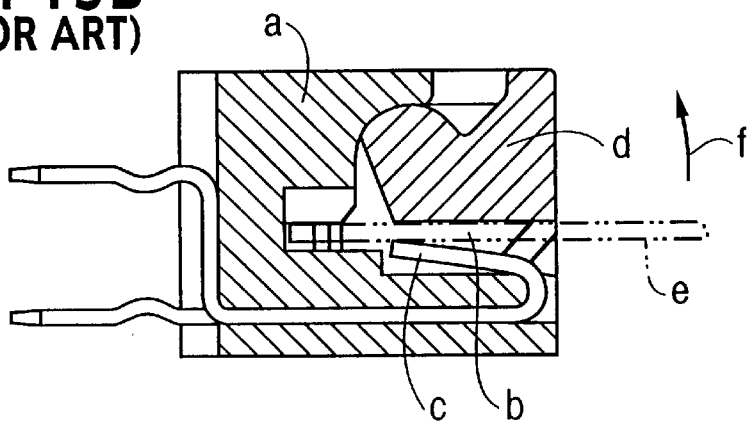
FIG. 19B (PRIOR ART)

The holder 150 is formed uniformly with the housing body 110A as described above and forms a part of the connector housing 110. The holder 150 serves as an attachment member for fixing the connector housing 110 to the circuit board, a pair of left and right holders 150 being attached to the housing body 110A. The holder 150 is formed by bending and cutting a metal plate into a specified shape and, as shown in FIG. 18, comprises an attachment member 151 protruding anteriorly, a plate shaped fixing member 152 that protrudes exteriorly from the posterior end of the attachment member 151, and a cam receiving member 153 rising up from the exterior edge of the fixing member 152 and protruding anteriorly. This cam receiving member 153 can bend upwards resiliently and, as described further on, due to the recovery force exerted by the resilience of the cam receiving member 153, a force applies on the supporting member 130 towards the supporting position or the releasing position.

FIG. 18 shows the holder 150 that is attached to the left side of the housing body 110A. The holder 150 attached to the right side is the laterally inverted mirror image of the holder 150 shown in FIG. 18 and accordingly a detailed explanation thereof is omitted.

Figure 13:
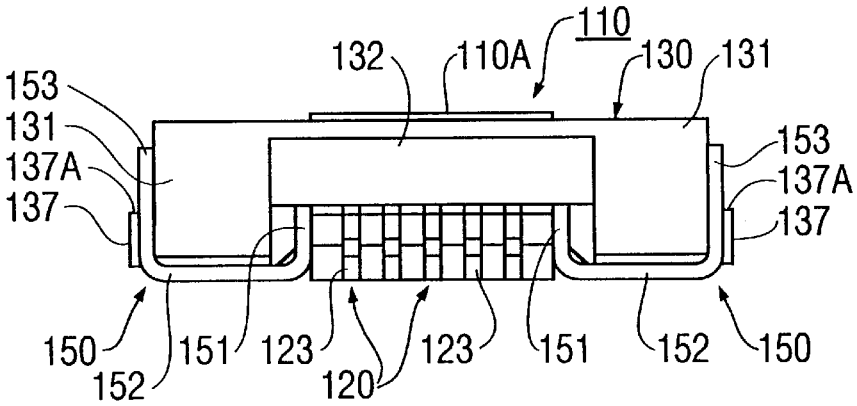
FIG. 13 is a rear view of the connector from the side opposite to the insertion side showing a state whereby the supporting member is in the supporting position.

The holder 150 is unified with the housing body 110A by inserting the attachment member 151 into the attachment hole located at the posterior end of the housing body 110A. As shown in FIG. 13, the lower face of the fixing member 152 is alongside the base face of the housing body 110A. The fixing operation of the connector housing 110 to the circuit board is carried out by placing the fixing member 152 on the upper face of the circuit board and soldering it thereon.

Figure 14A:
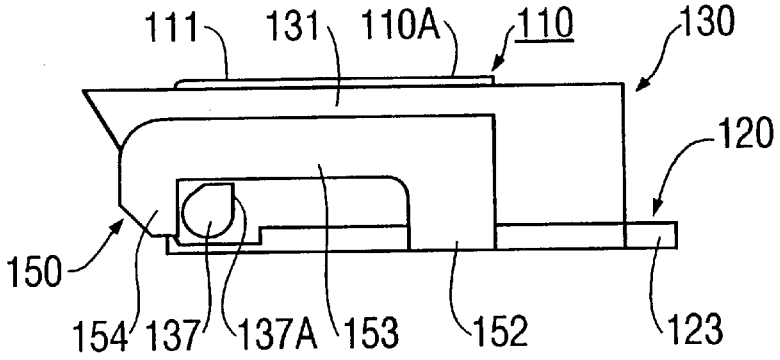
FIG. 14A is a side view of the connector showing the supporting member in the supporting position.

In the state where the holder 150 is attached to the housing body 110A, the cam receiving members 153 come to extend along the external side faces of the lever members 131 of the supporting members 130, as shown in FIG. 13. As shown in FIG. 14A, the height of each cam receiving member 153 is set so that when the supporting member 130 is in the supporting position the lower face of the cam receiving member 153 makes resilient contact with one of the side faces of a cam member 137A.

Figure 14B:
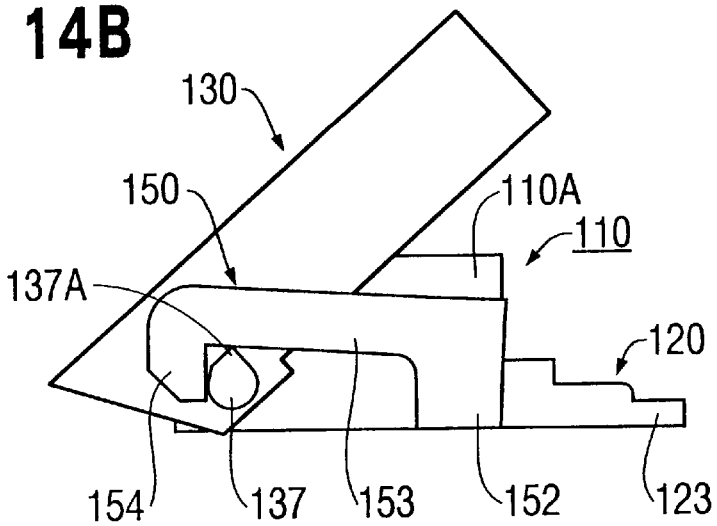
FIG. 14B is a side view of the connector showing the supporting member in the intermediate position.
Figure 14C:
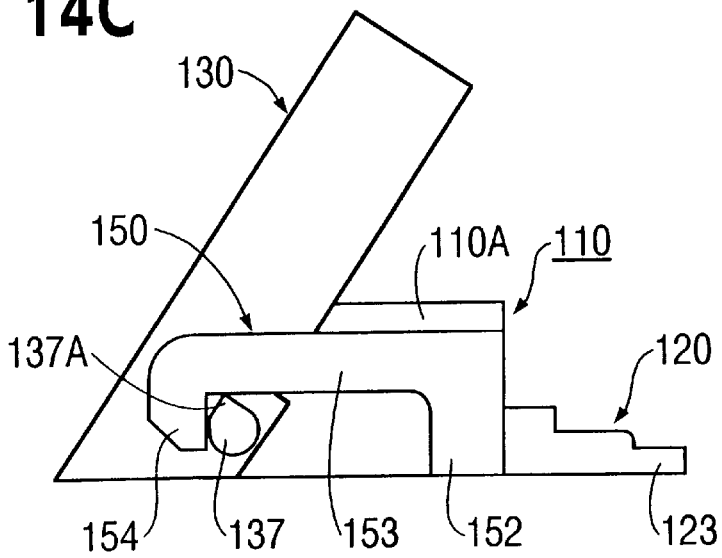
FIG. 14C is a side view of the connector showing the supporting member in the releasing position.
Figure 15:
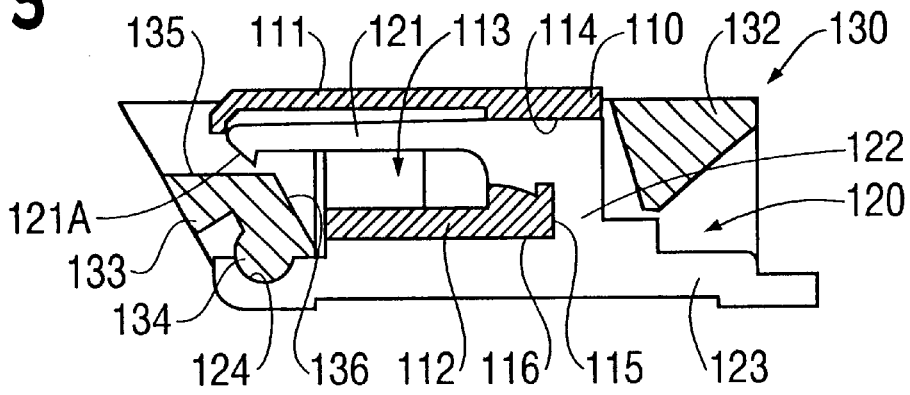
FIG. 15 is a cross-sectional view showing a state prior to the insertion of a ribbon cable where the supporting member is in the supporting position.
Figure 16:
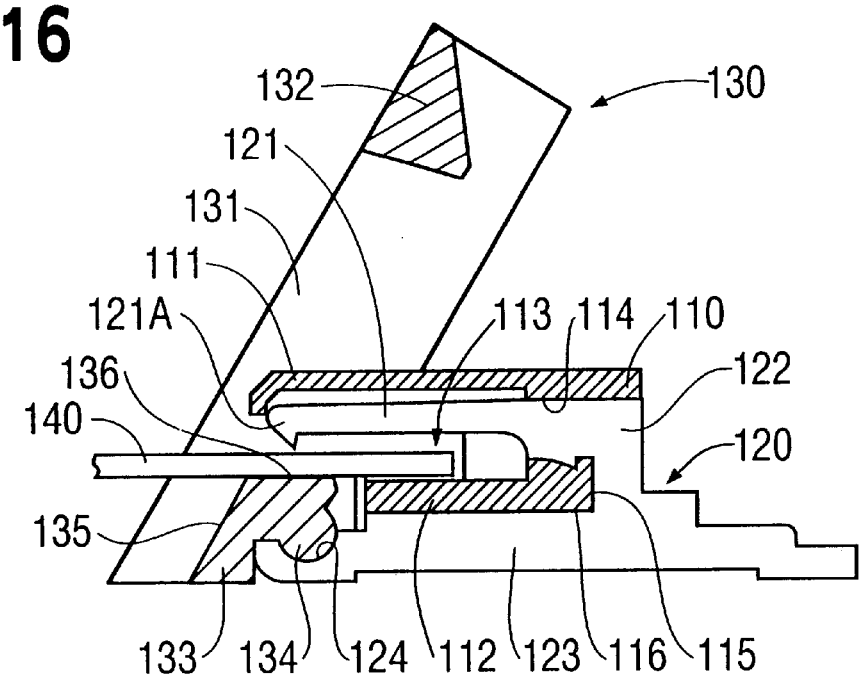
FIG. 16 is a cross-sectional view showing a state whereby the supporting member has been moved to the releasing position and the ribbon cable has been inserted.
Figure 17:
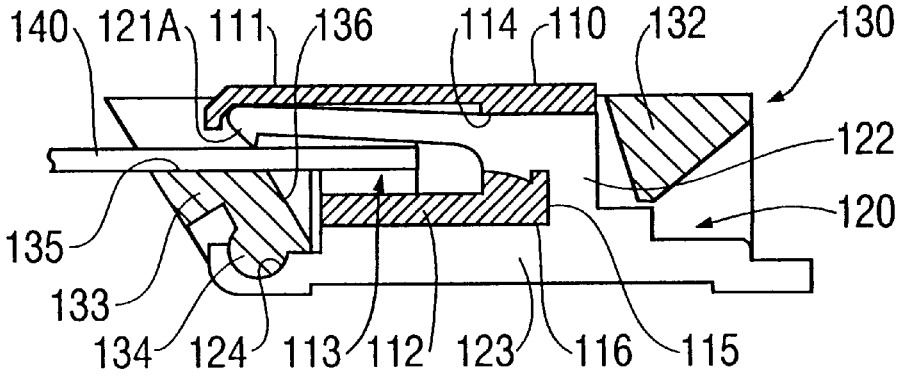
FIG. 17 is a cross-sectional view showing a state where the supporting member has been moved to the supporting position and the ribbon cable has been clamped and supported between the terminals.

When the supporting member 130 is moved from the supporting position to the releasing position, the anterior end of the pushes the lower face of the cam receiving member 153 and thereby causes it to bend upwards resiliently. Further, as shown in FIG. 14B, when the cam member 137A is moved in a clockwise direction (to the supporting position) past an intermediate position where the amount of bending of the cam receiving member 153 is at its maximum, a rotative force is applied on the supporting member 130 due to the recovery force exerted by the cam receiving member 153. On the other hand, when the cam member 137A inclines away from this intermediate position in an anti-clockwise direction, a force applies on the supporting member 130 in the direction of the releasing position.

Thus the supporting member 130 can be temporarily held in the releasing position, and retained in the supporting position.

In the embodiment described above, the means for maintaining the supporting member 130 in the supporting position or in the releasing position, is the recovery force of the holder 150. Consequently, in contrast to the case where the force due to the resilience of the terminal 120 is utilized, there is no possibility of the terminal 120 applying a contact pressure in excess of the normal contact pressure applied on the ribbon cable 140.

Further, since the holder 150 formed on the cam receiving member 153 is made from metal, a large force can be exerted without making the cam receiving member large.

Since the cam receiving member 153 is provided along the external side face of the housing body 110A, even in the case where the bending stroke of the cam receiving member 153 is large in order to exert a sufficient force along the entire width of the supporting member 130, there is no need to increase the height of the housing body 110A. Furthermore, in the present embodiment, the axle 137 is prevented from moving upwards or anteriorly when the supporting member 130 is raised, thereby allowing the supporting member 130 to be rotatively operated in a stable manner.

The present invention is not limited to the embodiments described above. For example, the possibilities described below also lie within the technical range of the present invention. In addition, the present invention may be embodied in various other ways without deviating from the scope thereof.

(1) Although in the first and second embodiments the supporting member is formed in a unified manner on the axis of the operating lever, the configuration may equally be so that the supporting member is provided separately from the operating lever and is axially supported in a rotative manner, the supporting member rotating in a unified manner between the supporting position and the releasing position in accompaniment with the moving operation of the operating lever.

(2) The present invention is also applicable in the case of a flat cable connector in which a plurality of round electric wires are aligned and layers of resin film are formed on their outer and inner faces.

(3) Although in the third embodiment the cam receiving member is formed on a holder which serves to attach a connector housing to a circuit board, according to the present invention, it may equally be arranged that a cam receiving member is attached to the housing body, this cam receiving member being distinct from the holder. Alternatively, it may equally be arranged so that a portion of the housing body constitutes the cam receiving member.

(4) Although in the third embodiment the cam member is formed in a unified manner with the axle, according to the present invention it may equally be arranged so that the cam member is provided separately from the axle.

What is claimed is:

1. An electrical connector for attachment to the end of a flat electrical conductor, the connector comprising a housing having a base with a front end, a rear end, a forwardly opening mouth at the front end to receive a flat electrical conductor, and a longitudinal axis extending between said front and rear ends, an electrical terminal in the housing having a contact member protruding into said mouth, and a lever with a clamp portion, said lever being pivotably mounted on the housing for movement between an open condition, in which said clamp portion projects in a forward direction such that said mouth is open, and a closed condition in which said clamp portion of said lever protrudes towards said contact member and into said mouth to clamp said conductor against said terminal, thereby making an electrical connection, the lever further having a pair of arms and a pressing member at one end thereof, the arms being positioned along opposite sides of said housing, the pressing member being movable towards said rear end of said base to move the lever from the open condition to the closed condition, the clamp portion being movable in a direction opposite to the direction of movement of the pressing member, and in the closed condition said pressing member being located at the rear end of the housing remote from the opening of said mouth and said arms being along side said housing and generally parallel to the longitudinal axis of the base.

2. A connector according to claim 1 wherein the pivot axis of said lever is on said opposite side of said mouth to said contact member.

3. A connector according to claim 2 wherein the pivot axis of said lever is farther from the opening of said mouth than the contact member of said terminal.

4. A connector according to claim 1 wherein the lever includes another pressing member at the opposite end thereof, and movable towards said base from closed to the open condition.

5. A connector according to claim 4 wherein said pressing members include anti-skid pressing surfaces.

6. A connector according to claim 1 wherein in use said terminal includes a connection portion protruding from said housing in the same direction as said conductor and between said pivot axis and said base.

7. A connector according to claim 1 and further including supporting means to releasably maintain said lever in the open condition.

8. A connector according to claim 7 wherein said supporting means is adapted to releasably maintain said lever in the closed condition.

9. A connector according to claim 7 and further including a support attachable to said housing and adapted for attachment to a mounting surface in order to fix said connector on the mounting surface, the support including a resilient arm extending therefrom, and said lever including a protruding axle on said pivot axis, said axle including a cam profile thereon and having a peak engageable with said resilient arm intermediate the open and closed conditions, thereby to urge the lever to the open condition or to the closed condition.

10. A connector according to claim 8 and further including a support attachable to said housing and adapted for attachment to a mounting surface in order to fix said connector on the mounting surface, the support including a resilient arm extending therefrom, and said lever including a protruding axle on said pivot axis, said axle including a cam profile thereon and having a peak engageable with said resilient arm intermediate the open and closed conditions, thereby to urge the lever to the open condition or to the closed condition.

11. A connector according to claim 1 wherein said lever is a rocker having oppositely extending arms and a centre pivot axis, the arms defining at opposite ends said pressing member and another pressing member, and said pivot axis being between said mouth and said base.

12. A connector according to claim 1 wherein said contact member includes a protruding member that protrudes into said mouth towards said base, and in the closed condition said clamp portion protrudes into said mouth from said base.

* * * * *